US010743595B2

(12) United States Patent
Destro et al.

(10) Patent No.: US 10,743,595 B2
(45) Date of Patent: Aug. 18, 2020

(54) FINGER GUARD

(71) Applicant: The Ford Meter Box Company, Inc., Wabash, IN (US)

(72) Inventors: Charles Miller Destro, Peru, IN (US); Oran Junior Weaver, Wabash, IN (US)

(73) Assignee: The Ford Meter Box Company, Inc., Wabash, IN (US)

( * ) Notice: Subject to any disclaimer, the term of this patent is extended or adjusted under 35 U.S.C. 154(b) by 198 days.

(21) Appl. No.: 15/710,907

(22) Filed: Sep. 21, 2017

(65) Prior Publication Data

US 2018/0077978 A1 Mar. 22, 2018

Related U.S. Application Data

(60) Provisional application No. 62/398,191, filed on Sep. 22, 2016.

(51) Int. Cl.
*A41D 13/08* (2006.01)
*A41D 19/015* (2006.01)

(52) U.S. Cl.
CPC ..... *A41D 13/087* (2013.01); *A41D 19/01517* (2013.01); *A41D 2600/20* (2013.01)

(58) Field of Classification Search
CPC ..... A41D 13/087; A41D 19/0086; A41D 19/01517; A41D 19/01505; A41D 19/01594; A41D 19/01588; A41D 2600/20; D05B 91/04; A45D 2029/008; A45D 29/22; D04B 3/04; A61F 5/05875
USPC ..... 2/21; 223/101; D24/190; D29/114; 132/285; D3/29
See application file for complete search history.

(56) References Cited

U.S. PATENT DOCUMENTS 203,978 A * 5/1878 Woods ..... A01G 3/00 47/1.01 R
450,447 A * 4/1891 Buchwalter ..... A41D 13/087 294/25
464,545 A * 12/1891 Wood ..... D05B 91/04 223/101

(Continued)

FOREIGN PATENT DOCUMENTS

DE 836594 C * 4/1952 ..... D05B 91/04

OTHER PUBLICATIONS

Plastic Hand Finger Guard Protector Knife Chop Cut Slice Helper, from: http://wholesaleatoz.com/Plastic-Hand-Finger-Guard-Protector-Knife-Cut-Slice-Helper; Dated Jul. 6, 2016.

(Continued)

*Primary Examiner* — Amy Vanatta
(74) *Attorney, Agent, or Firm* — Barnes & Thornburg LLP

(57) ABSTRACT

The present disclosure provides a compressive force finger guard sized to cover at least a portion of the distal phalanx portion of a finger. Illustratively, the compressive force finger guard includes a longitudinally-extending body portion; wherein the longitudinally-extending body portion includes an opening therein sized to receive at least a portion of the fingertip; and a cap tip located on an end of the longitudinally-extending body portion; and wherein the cap tip includes a flange that extends from the longitudinally-extending body portion generally transverse to the longitudinally-extending body portion.

13 Claims, 14 Drawing Sheets

(56) References Cited

U.S. PATENT DOCUMENTS 617,929 A * 1/1899 Fowble ..... A41D 13/087 2/21
931,511 A * 8/1909 Southworth ..... B26B 27/007 30/298
1,388,618 A * 8/1921 Stein et al. ..... A41D 13/087 2/21
1,563,954 A * 12/1925 Barton ..... D05B 91/04 223/101
1,806,730 A * 5/1931 Alland ..... D05B 91/04 223/101
1,917,794 A * 7/1933 Brown ..... A61F 5/11 602/22
2,460,155 A * 1/1949 Talarico ..... A61F 13/105 2/21
2,494,439 A * 1/1950 Gorka ..... D05B 91/04 7/121
4,102,480 A 7/1978 O'Beirne-Ranelagh
D270,966 S * 10/1983 Lynn ..... D05B 91/04 D3/29
4,654,895 A * 4/1987 Peters ..... A41D 19/0017 2/161.1
4,694,508 A * 9/1987 Iriyama et al. ..... A41D 13/087 2/160
4,765,116 A * 8/1988 Shank ..... E04G 21/1883 52/747.12
4,985,038 A * 1/1991 Lyell ..... A61B 17/0493 2/21
D316,931 S * 5/1991 Joy ..... D3/24
D327,772 S * 7/1992 Orr ..... D05B 91/04 D3/29
5,450,626 A 9/1995 Sorrels
5,647,063 A 7/1997 Bates
D401,404 S * 11/1998 Raterink ..... D3/29
6,243,868 B1 6/2001 Wanzenried
6,575,925 B1 6/2003 Noble
6,665,874 B2 12/2003 Stolf
6,684,406 B2 2/2004 Fowler
6,807,681 B2 10/2004 Sorrels
D553,804 S 10/2007 Kaposi
7,296,300 B2 11/2007 Votolato
D577,155 S 9/2008 Hauser
D657,095 S 4/2012 Logan
D713,998 S 9/2014 Tiller et al.
8,856,963 B2 10/2014 Nagda et al.
9,339,069 B2 5/2016 Mazzarolo
9,352,211 B2 5/2016 Aoki et al.
2014/0304879 A1* 10/2014 Sgombich Perez .. A41D 13/087 2/21
2016/0081404 A1* 3/2016 Visokey ..... A41D 13/087 2/161.6

OTHER PUBLICATIONS

Aliexpress Safety Cutting Tool Reviews, from: http://www.aliexpress.com/safety-cutting-tool_reviews.html, Dated Jul. 6, 2016.
Grainger Industrial Supply; Hand and Finger Guards, from: https://www.grainger.com/category/hand-and-finger-guards/gloves-and-hand-protection/safety/ecatalog/N-mlk?GID=&RIID=150572823&mid=Auto_Reorder; Dated Jul. 6, 2016.
Sporting Man Shooting Glove Two Fingers Black Cow Leather Handmade Archery Hand Finger Protection Cover Bow & Arrow, from https://www.dhgate.com/product/sporting-man-shooting-glove-two-fingers-black/383398481.html, Dated Jul. 6, 2016.
Aliexpress Surf/Pier Fishing Finger Glove Finger Protector—Fishing Glove, from: https://www.aliexpress.com/store/product/Free-Shipping-Surf-pier-fishing-finger-glove-Finger-Protector-fishing-glove/607274_864856154.html, Dated Jul. 6, 2016.

* cited by examiner

FINGER GUARD

RELATED APPLICATIONS

The present application relates to and claims priority to U.S. Provisional Patent Application, Ser. No. 62/398,191, filed on Sep. 22, 2016. The subject matter disclosed in that provisional application is hereby expressly incorporated into the present application in its entirety.

TECHNICAL FIELD AND SUMMARY

The present disclosure relates to finger safety features, and particularly to finger caps or guards that provide workplace finger protection.

Finger protection in an industrial environment is always a safety concern. Providing suitable finger protection is important when working around several types of work environments. For instance, thimbles have been used to protect fingers from needle punctures; finger sleeves or shrouds protect against cuts from knives or blades; and even gloves or tabs are used to protect fingers from archery bow strings.

In certain environments, however, it may be necessary to protect fingers, but not from slice or puncture wounds, but instead from compressive forces. Molding presses, for example, often create tremendous pressure between two molding plates in order to form the shape of a desired part. Often, the part to be molded needs to be manually inserted between the two plates of the press. In this instance, it may be useful to provide finger protection specifically resistant to compressive forces (rather than slicing or puncture forces). In another illustratively additional and/or alternative embodiment, it may also be useful to provide finger protection that limits access the fingers may otherwise have to space between press plates, clamps, etc. In this instance, the operator may still be able to insert or remove the part, but the fingers themselves, because of the finger guards of the present disclosure, are not able to physically be positioned between the press plates.

Accordingly, an illustrative embodiment of the present disclosure provides a compressive force finger guard sized to cover at least a portion of the distal phalanx portion of a finger. The compressive force finger guard comprises: a longitudinally-extending body portion sized to shroud at least the portion of the distal phalanx portion of the finger; wherein the longitudinally-extending body portion includes an opening therein sized to receive at least a portion of the fingertip of the distal phalanx opposite its fingernail to expose the least the portion of the fingertip; a cap tip located on an end of the longitudinally-extending body portion and sized to cover the end of the distal phalanx portion of the finger; wherein the cap tip includes a flange extending generally transverse to the longitudinally-extending body portion; wherein the flange extends from the longitudinally-extending body portion generally transverse to the longitudinally-extending body portion such that at least a portion of the flange extends above the longitudinally-extending body portion; wherein the cap tip includes a chamfered surface located adjacent the opening formed in the body portion; wherein the chamfered surface extends between the flange and the opening formed in the body portion; and wherein the finger guard is sized to not fit into a space formed between structures that the distal phalanx portion of the finger will otherwise fit into without use of the compressive force finger guard.

In the above and other illustrative embodiments, the compressive force finger guard may further comprise: a strap that surrounds at least a portion of the finger to secure the compressive force finger guard to the finger; the strap is biased toward the finger to secure the compressive force finger guard to the finger; the longitudinally-extending body portion including a space located between the longitudinally-extending body portion and the strap; the compressive force finger guard being fitted inside a finger portion of a glove; the compressive force finger guard being made from a polymer material; at least the strap being made from a polymer that creates the bias toward the finger to secure the compressive force finger guard to the finger; the flange being radially arcuate; and the strap being resilient to create the bias toward the finger to secure the compressive force finger guard to the finger.

Another illustrative embodiment of the present disclosure provides a compressive force finger guard sized to cover at least a portion of the distal phalanx portion of a finger. This compressive force finger guard comprises: a longitudinally-extending body portion; wherein the longitudinally-extending body portion includes an opening therein sized to receive at least a portion of the fingertip; and a cap tip located on an end of the longitudinally-extending body portion; wherein the cap tip includes a flange that extends from the longitudinally-extending body portion generally transverse to the longitudinally-extending body portion.

In the above and other illustrative embodiments, the compressive force finger guard may further comprise: the cap tip includes a chamfered surface located adjacent the opening formed in the body portion; the chamfered surface extends between the flange and the opening formed in the body portion; a strap that surrounds at least a portion of the finger to secure the compressive force finger guard to the finger; the strap being biased toward the finger to secure the compressive force finger guard to the finger; and the longitudinally-extending body portion including a space located between the longitudinally-extending body portion and the strap.

Another illustrative embodiment of the present disclosure provides a compressive force finger guard sized to cover at least a portion of the distal phalanx portion of a finger. This compressive force finger guard comprises: a longitudinally-extending body portion sized to shroud at least the portion of the distal phalanx portion of the finger; and a cap tip located on an end of the longitudinally-extending body portion and sized to cover at least a portion of the distal phalanx portion of the finger; wherein the cap tip includes a flange extending generally transverse to the longitudinally-extending body portion; wherein the finger guard is sized to not fit into a space formed between structures that the distal phalanx portion of the finger will otherwise fit into without use of the compressive force finger guard.

In the above and other illustrative embodiments, the compressive force finger guard may further comprise: a strap that surrounds at least a portion of the finger to secure the compressive force finger guard to the finger; the strap is biased toward the finger to secure the compressive force finger guard to the finger; the longitudinally-extending body portion sized to shroud at least the portion of a fingertip portion of the distal phalanx portion of the finger opposite a finger nail portion; and wherein the longitudinally-extending body portion includes a space located between the longitudinally-extending body portion and the flange.

Additional features and advantages of the compressive force finger guard will become apparent to those skilled in the art upon consideration of the following detailed description of the illustrated embodiments exemplifying best modes of carrying out the compressive force finger guard as presently perceived.

BRIEF DESCRIPTION OF THE FIGURES

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity.

Figure 1:
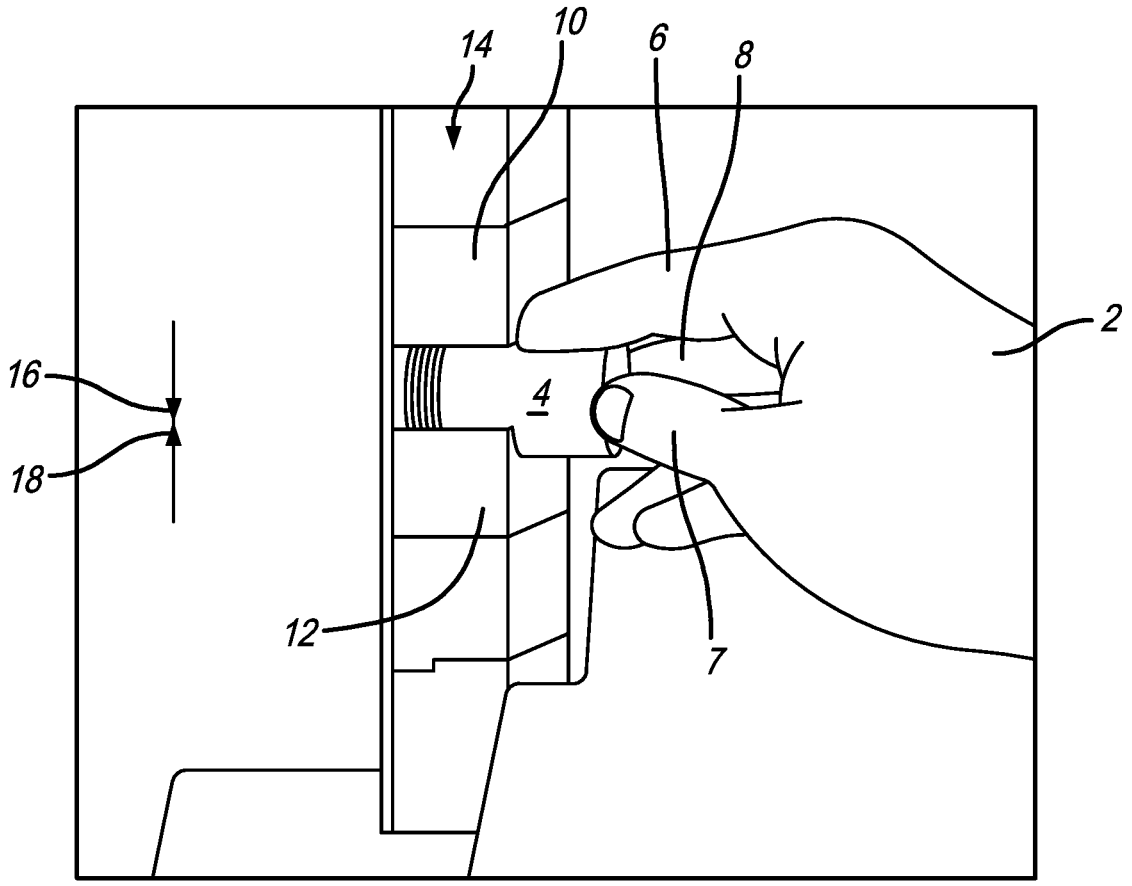
FIG. 1 PRIOR ART
FIG. 1 is a PRIOR ART perspective view of a hand grasping a part of a workpiece in a press.

Corresponding reference characters indicate corresponding parts throughout the several views. The exemplification set out herein illustrates embodiments of the compressive force finger guard and such exemplification is not to be construed as limiting the scope of the compressive force finger guard in any manner.

DETAILED DESCRIPTION OF ILLUSTRATIVE EMBODIMENTS

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

In an illustrative embodiment of the present disclosure, a finger guard or cap is provided to resist compressive and/or access to the space between press plates. It is appreciated that according to this present disclosure and depending on the particular application, these finger guards may serve either one or both of these stated functions. Additionally, even though the guards may be described as coupling to a particular finger, they may be used with any or all of a person's fingers on the right hand, left hand, or both hands. In an illustrative embodiment, the finger guard may include a body portion that is bounded by a strap or other similar structure to affix the guard to the finger and then a cap tip at the other end. The cap tip typically includes a flange portion that is larger than a typical fingertip to serve as a barrier that may resist certain compressive forces and makes the finger too large to get into the space between two press plates. Illustratively, a chamfered surface may be formed between the body and the cap tip so as to reduce interference and/or allow a better tactile feel by the finger when grasping or otherwise touching a part.

A perspective view of a hand 2 grasping a part of workpiece 4 using fingers 6, 7, and 8 is shown in PRIOR ART FIG. 1. Workpiece 4 is located between plates 10 and 12 of press 14. This view is PRIOR ART not because of press 14 or workpiece 4, however. Rather, it is PRIOR ART because of bare fingers 6, 7, and 8 that are not only holding workpiece 4 but are holding it against plates 10 and 12 as shown. Although this is not a sanctioned procedure on how to position workpiece 4 in press 14, it is conceivable that when performing such operations fingers 6, 7, 8 (as well as the others) may come in close proximity to the space between plates 10 and 12. It is appreciated that plates 10 and 12 are intended to move together in directions 16 and 18, respectively, as illustratively shown, to apply the compressive force against workpiece 4. It is conceivable that one or more fingers may get between workpiece 4 and one of the plates either 10 or 12 which, when moved together in directions 16 and 18, will compress and cause injury to said fingers.

Figure 2:
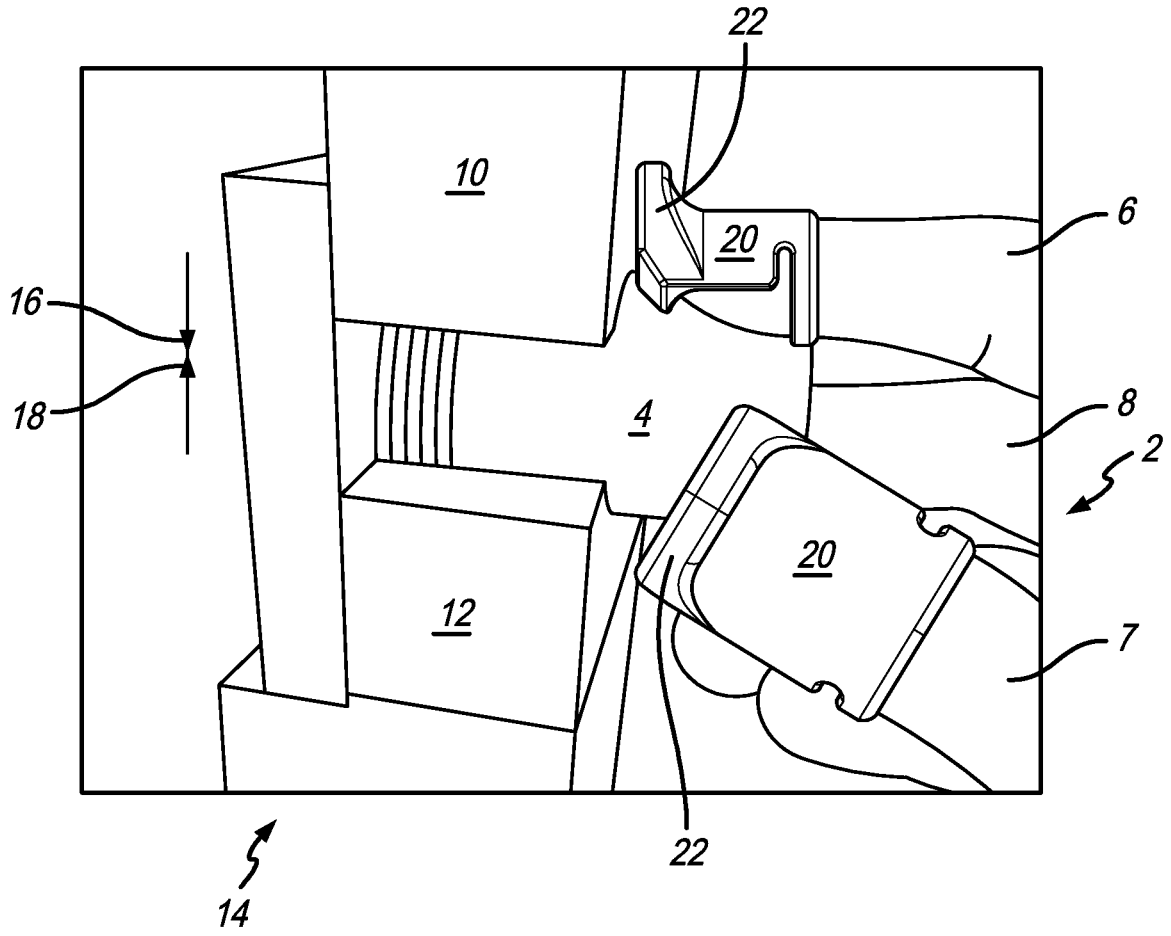
FIG. 2 is a detailed perspective view of a hand employing a compressive force finger guard grasping a part of a workpiece in a press.

A similar, but detailed, perspective view of hand 2 is shown in FIG. 2. Instead of bare fingers coming in contact with compressive bodies, however, finger guards 20 are fitted onto fingers 6 and 7, respectively, to protect them in such situations. These illustratively shown finger guards are collectively identified by reference numeral 20. It is appreciated that they may be either uniformly sized or differently sized to accommodate fingers of differently sized hands or differently sized fingers. For example, it is appreciated that finger guards 20 may be sized to accommodate fingers on a smaller hand or on a larger hand. It is further appreciated that each finger guard may be differently sized to accommodate a thumb, index finger, etc.

As will be discussed further herein, illustrative finger guard 20 is an over-finger design. This finger guard 20 includes a guard tip 22 that extends upwardly above a top surface of finger 6 or 7. This serves to provide a structural support in case the finger gets between plate 10 and workpiece 4, but also to serve as a barrier, as shown. This prevents finger 6 or 7 from getting between workpiece 4 and plates 10 or 12 to begin with. By serving as an obstruction, guard tip 22 possibly limits the opportunity of creating a work place hazard if the fingers are physically unable to fit between the press plates. This view also makes clear that finger guard 20 may be used on any number of fingers necessary to protect them from harm while operating press 14. It will be further appreciated by the skilled artisan upon reading this disclosure that the application of these finger guards extends beyond illustrative press 14. For example, they may be used in conjunction with clamps, a vice, pliers, or any other like clamping or compressing tool.

Figure 3:
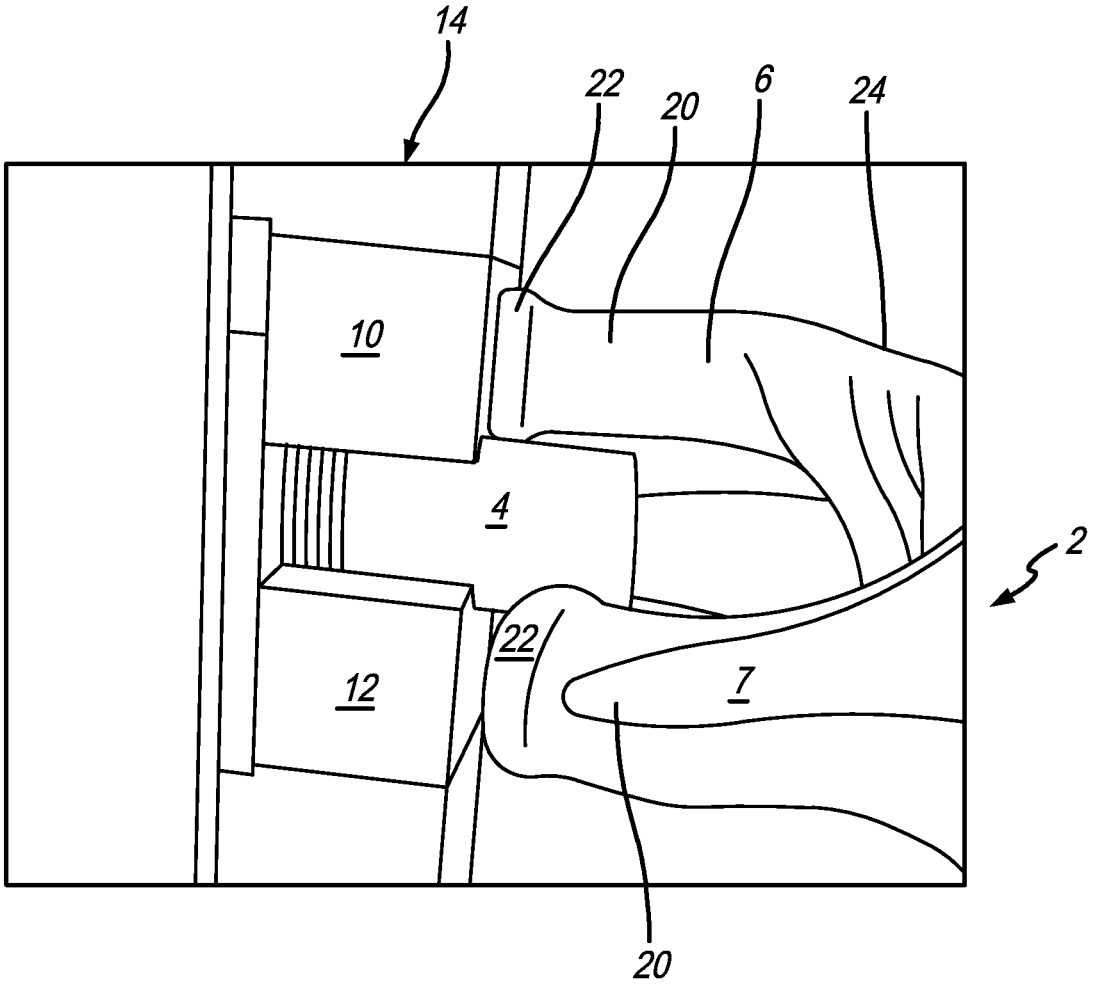
FIG. 3 is another perspective view of a hand employing a compressive force finger guard glove to grasp a workpiece.
Figure 4:
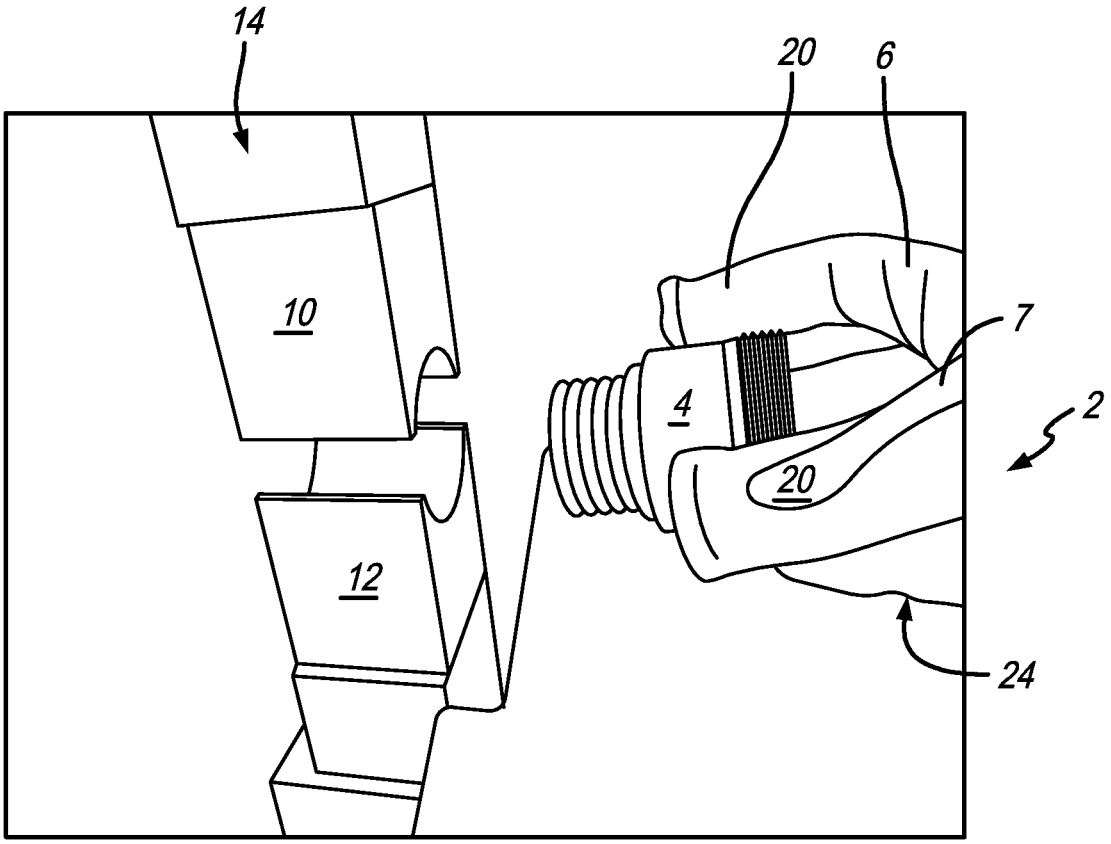
FIG. 4 is a perspective view similar to FIG. 3 with the hand wearing the compressive force finger guard glove removing the workpiece from the press.

Perspective detail views of hand 2 placing workpiece 4 between plates 10 and 12 of press 14 and removing from same are shown in FIGS. 3 and 4, respectively. A distinction in these views demonstrate the use of finger guard 20 when fitted inside glove 24. It is appreciated from these views how finger guard 20, with guard tip 22 extending therefrom, may be placed inside glove 24 to provide different use options. The perspective view of press 14, with hand 2 in glove 24 handling workpiece 4, further demonstrates how finger guards 20 may be used while still being able to manipulate workpiece 4. As a consequence, an added layer of protection is provided to the fingers without impairing their ability to handle the workpiece.

Figure 5:
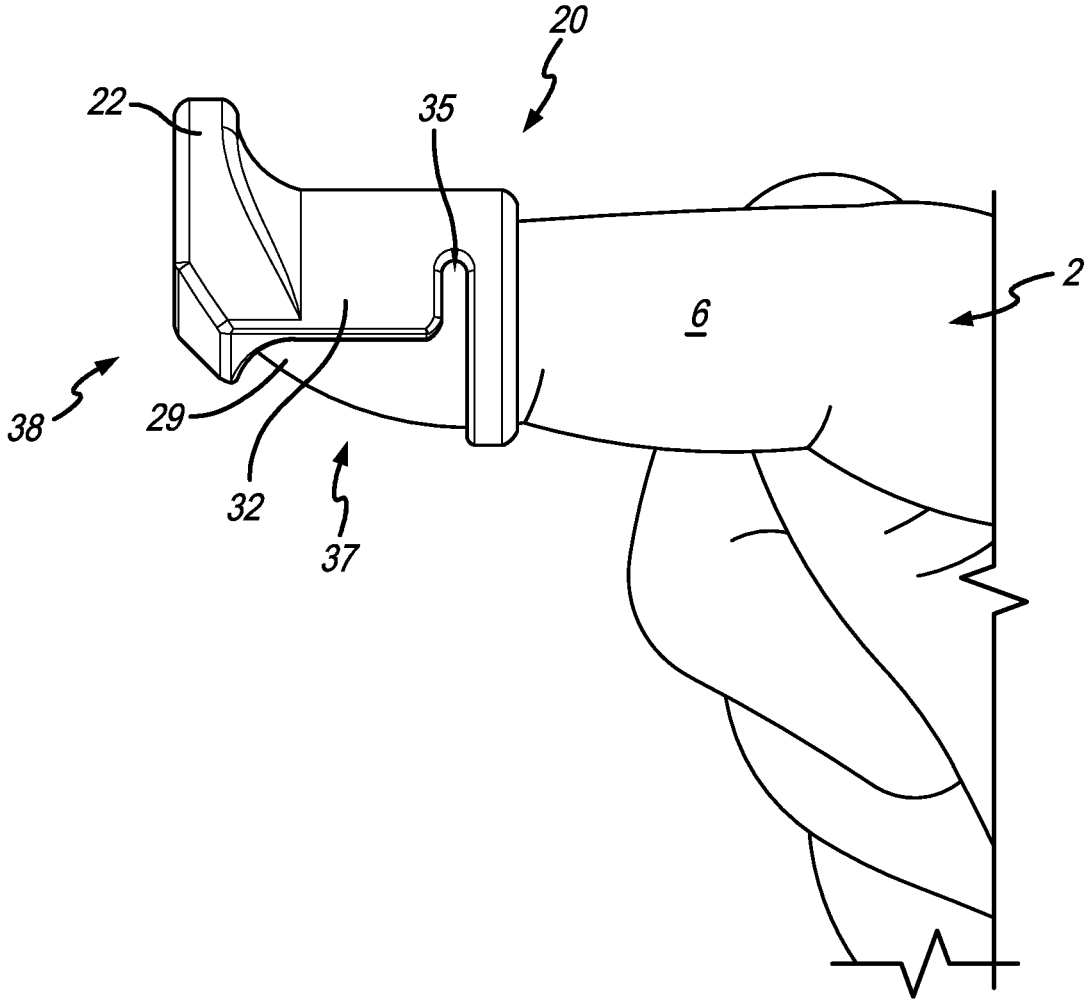
FIG. 5 is a side view of a hand wearing a compressive force finger guard fitted onto the finger.

A side view of hand 2 with finger guard 20 fitted onto finger 6 is shown in FIG. 5. Finger guard 20 is shown including guard tip 22, body 32, and finger strap 33. A space 35 is located between body 32 and finger strap 33. Also shown is a chamfered surface 38 that angles between guard tip 22 and body 32. It is appreciated in this view how body 32 shrouds the upper side (fingernail side) of finger 6, and downwardly depends, leaving an opening 29 to allow the underside of fingertip 37 exposed. This allows the user to gain the benefits of finger guard 20 while maintaining a tactile feel on whatever is being gripped. In some instances, a bare finger or minimum amount of obstruction between the finger and the work piece may be necessary to perform a particular task. In this case, with underside fingertip 37 exposed while body 32 and tip guard 22 shroud finger 6, finger guard 20 may still operate to prevent fingers from going where they should not go and/or mitigate bodily harm caused by compressive forces acting on improperly placed fingers.

Figure 6:
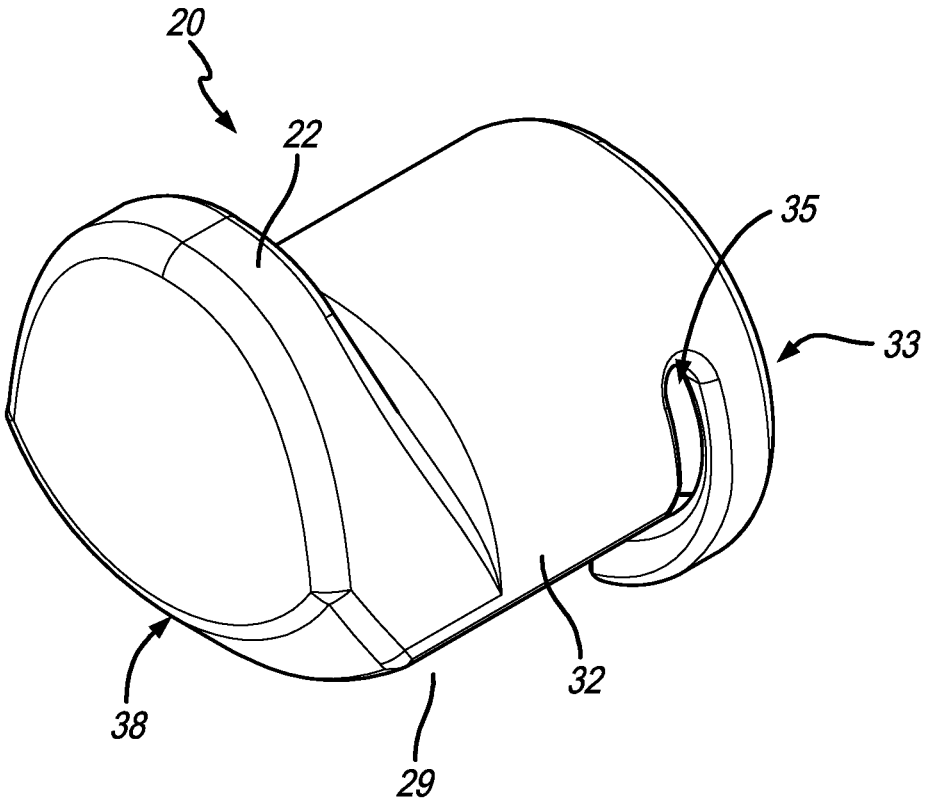
FIG. 6 is a perspective view of a compressive force finger guard.

A perspective view of finger guard 20 is shown in FIG. 6. This view also depicts guard tip 22, body 32, finger strap 33, space 35, chamfered surface 38, and opening 29. In the illustrated embodiment, guard tip 22 is a rounded surface that extends above body 32. The guard tip 22 comprises a flange, as seen in FIGS. 5 and 6. The lower end of guard tip 22 terminates at chamfered surface 38 then angles back towards opening 29 for the finger so finger guard 20 is not too cumbersome to wear while performing work functions. Body 32 is also configured to wrap at least partially around the finger to help shroud, set, and hold finger guard 20 onto the finger. Finger strap 33 is configured to wrap at least partially around a finger and bias towards same to secure finger guard 20 onto the finger. Space 35 assists in making finger strap 33 resilient when made out of a polymer-type material that creates the inward bias towards the finger.

Figure 7:
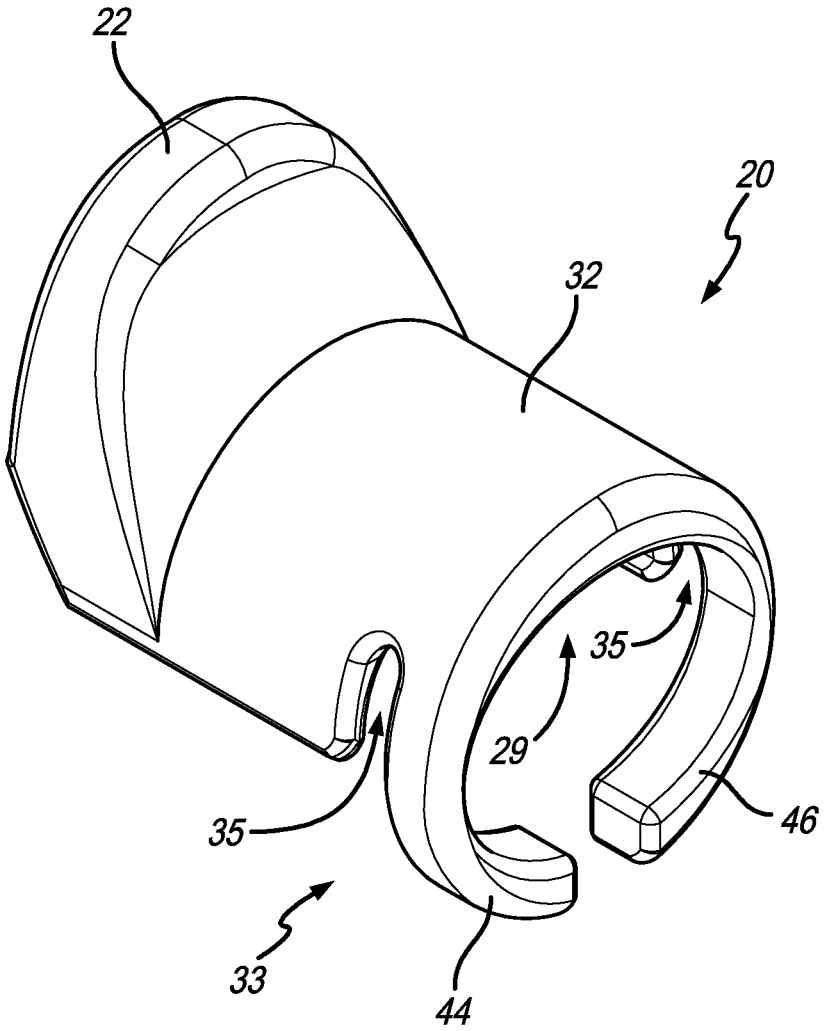
FIG. 7 is a rear perspective view of the compressive force finger guard.

A rear perspective view of finger guard 20 is shown in FIG. 7. This view further demonstrates how guard tip 22 extends above body 32 to help mitigate a compressive force that might otherwise act on the finger. This view also shows an illustrative embodiment of finger strap 33. Strap 33 is illustratively made of a resilient material that will bias to maintain its arcuate position as shown. Being flexible, strap 33 is able to flex outward to receive the finger and then move back into place gripping the finger to hold onto same.

Figure 8:
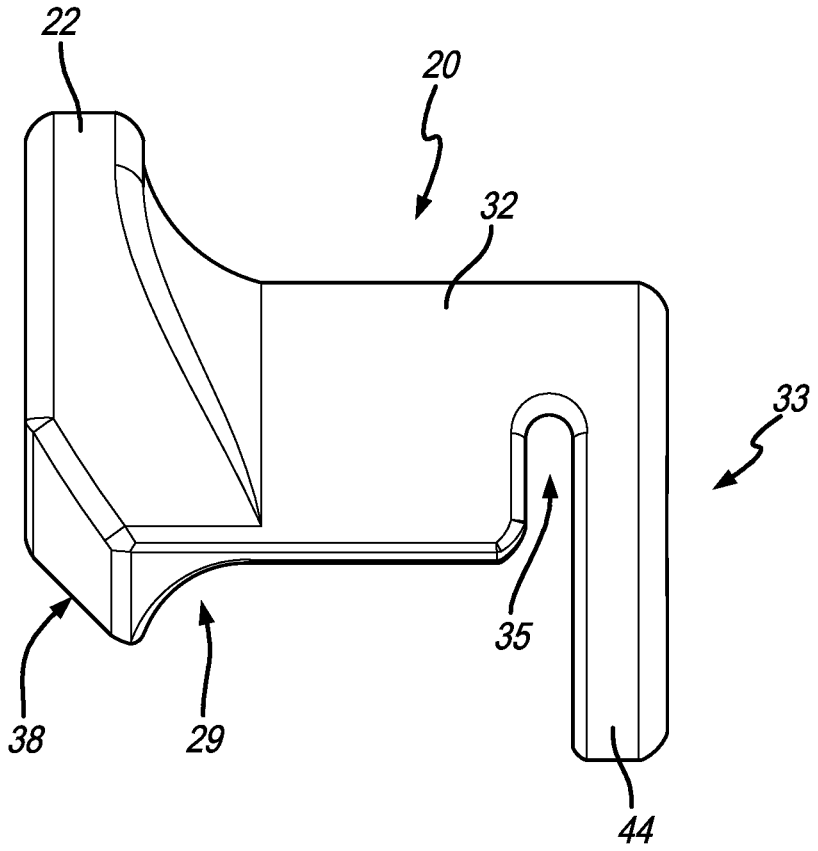
FIG. 8 is a side view of the compressive force finger guard.
Figure 9:
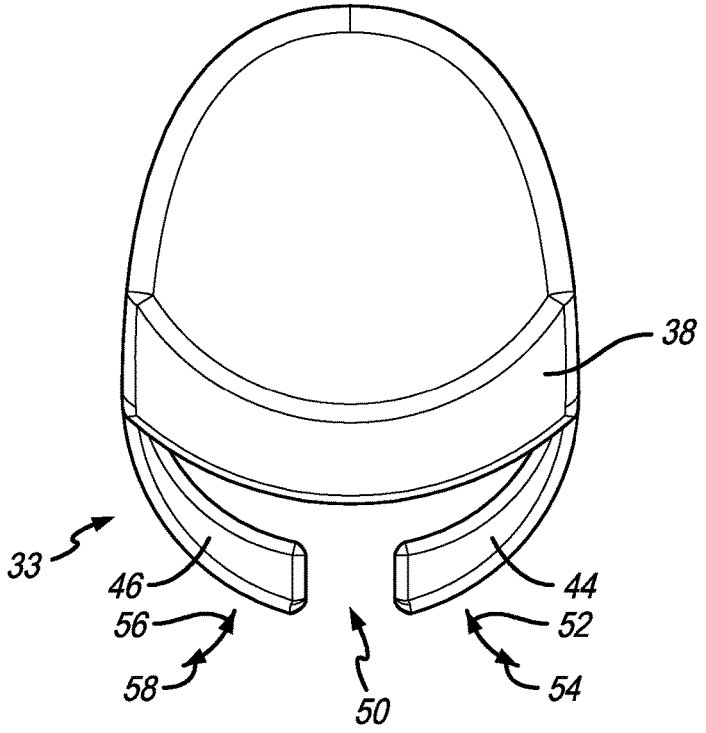
FIG. 9 is a front view of the compressive force finger guard.
Figure 10:
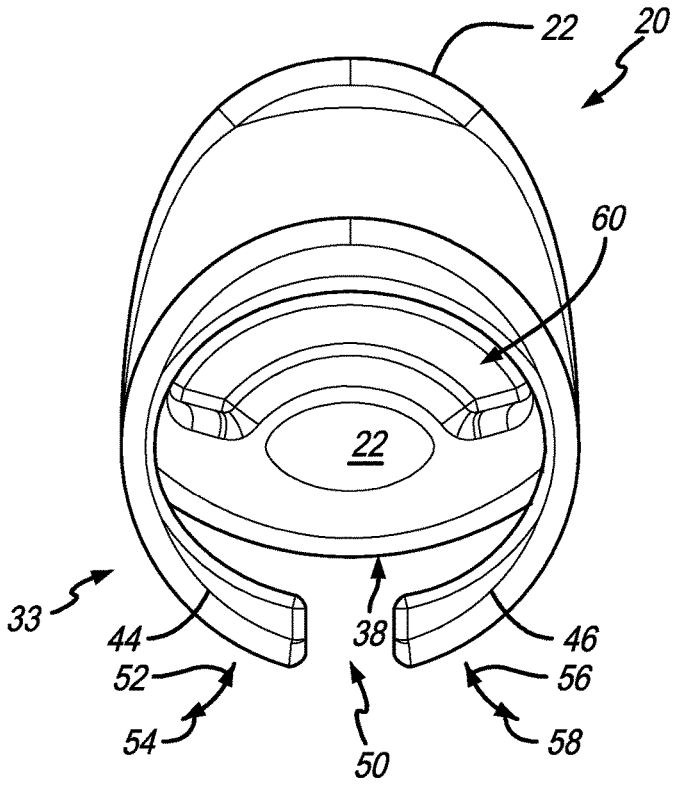
FIG. 10 is a rear view of the compressive force finger guard.

Side, front, and rear views of finger guard 20 are shown in FIGS. 8, 9, and 10, respectively. The side view in FIG. 8 further illustrates how guard tip 22 extends higher than body 32 to serve as an obstruction making it difficult to insert fingers into clamping spaces. Guard tip 22 also provides a body having a larger cross section than the finger to prevent a tool from clamping down directly onto the finger. Chamfered surface 38 is illustratively shown curved back from guard tip 22 to body 32.

The front view of finger guard 20 shown in FIG. 9 not only depicts guard tip 22 and chamfered surface 38 but also strap portions 44 and 46 of finger strap 33. In this illustrative embodiment, strap portions 44 and 46 are connected to body 32, but are illustratively not connected on the opposite end leaving a gap 50 located therebetween as shown. Again, it is contemplated that strap portions 44 and 46 may be made from a resilient material, and as shown, are curved in an arcuate manner.

The rear view of finger guard 20 is shown in FIG. 10. This view depicts opening 60 formed within strap portions 44 and 46 and at least partially defined by body 32. Opening 60 is also through which the finger is inserted to fit into finger guard 22. In order to secure finger guard 20 onto the finger, the periphery of a portion of finger opening 60 (see, also, e.g., FIGS. 5 and 7) is bounded by strap portions 44 and 46 which may form an at least semicircular strap 33. Illustratively strap portions 44 and 46 may have a lesser diameter than a typical finger. This means each strap portion 44 and 46 is movable in directions 54 and 58, respectively, thereby widening the opening in order to receive the finger. Bias of each strap portion 44 and 46 created by their resiliency will try to move them back into position in directions 52 and 56. This bias against the finger will hold finger guard 20 onto the finger.

Figure 11:
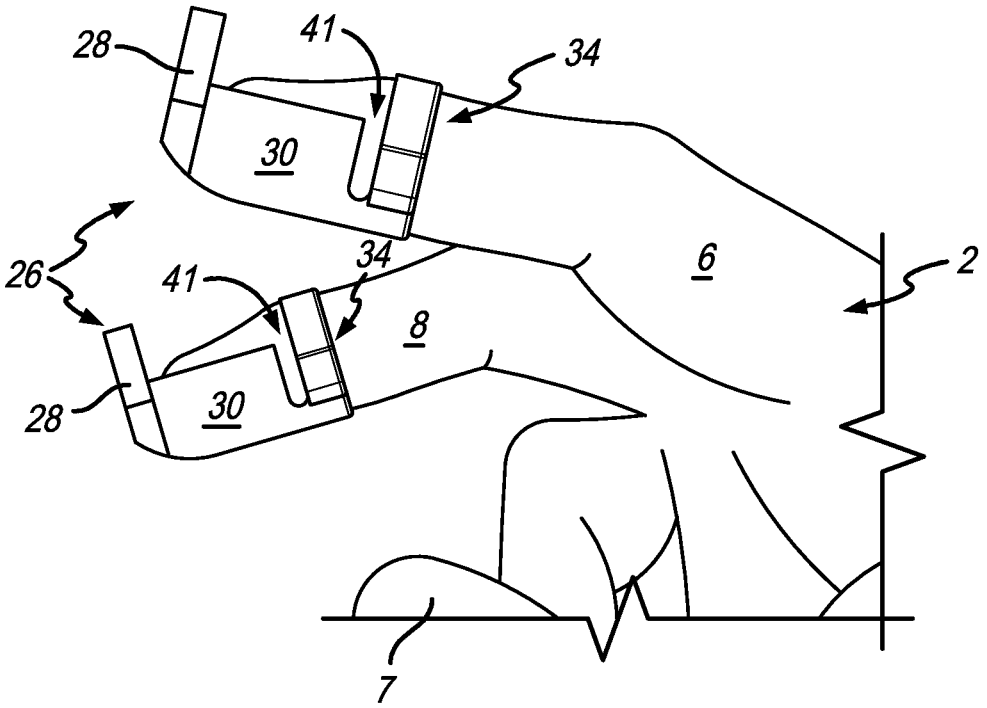
FIG. 11 is a side perspective view of another illustrative embodiment of a compressive force finger guard.

The perspective view in FIG. 11 depicts fingers 6 and 8 of hand 2 receiving another illustrative embodiment of a finger guard 26. Similar to finger guard 20, finger guard 26 includes an upward extending guard tip comprising a flange 28. In contrast to finger guard 20, an underside body 30 of finger guard 26 shrouds the fingertip portions of fingers 6 and 8 as shown. It is appreciated that an illustrative difference between finger guards 20 and 26 may be attributed to different potential uses. For example, finger guard 20 has its body 32 designed to be located over the fingernail portion (see, e.g., FIG. 2) of finger 6 where having a tactile feel between the finger and the workpiece may be a consideration. Conversely, body 30 of finger guard 26 covers the pad of the fingertip where such tactile feel is not necessary or an alternate reason exists to cover the fingertips. As also shown in this embodiment, finger guard 26 secures to finger 6 or 8 via an illustrative finger strap 34. Acting as a resilient band that wraps around a substantial portion of the user's finger, finger strap 34 essentially hugs the finger keeping the finger guard 26 secured thereon.

Figure 12:
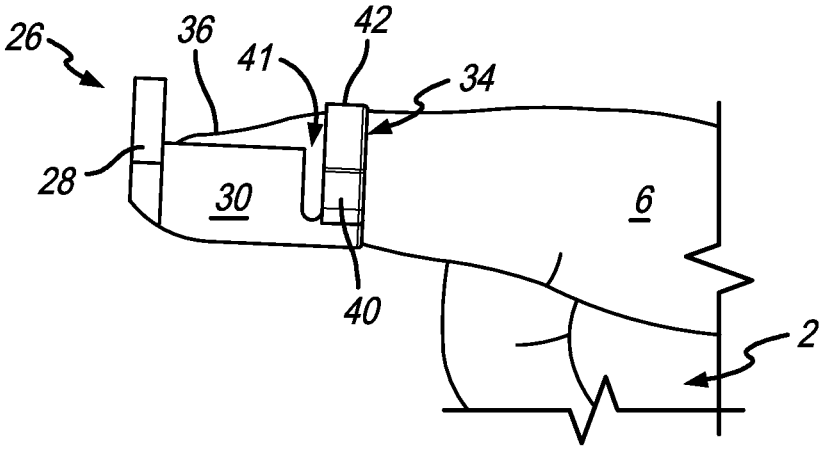
FIG. 12 is a side view of a finger wearing the compressive force finger guard of FIG. 11.
Figure 13:
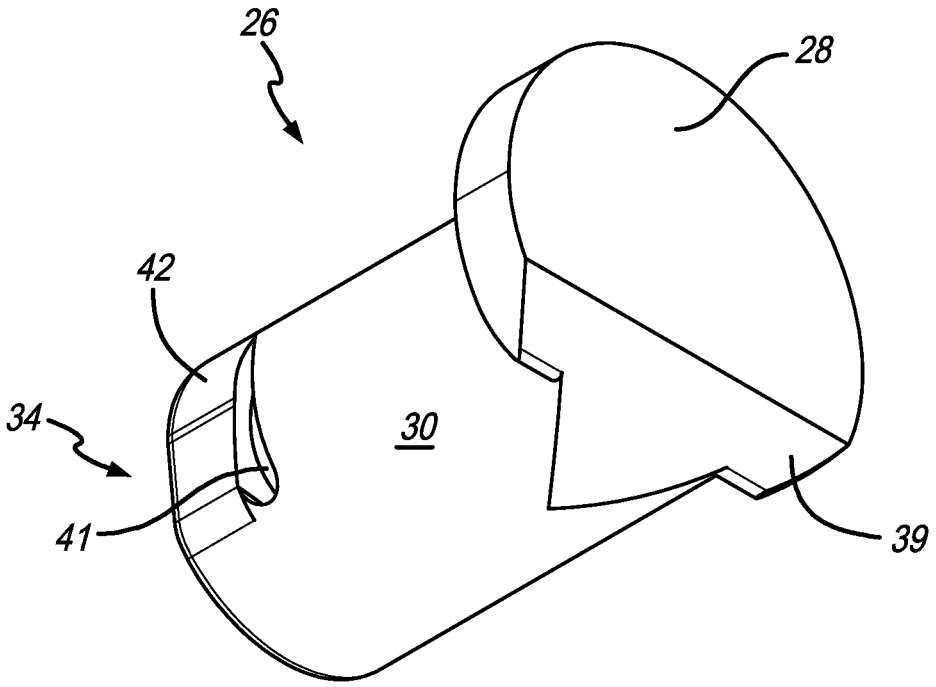
FIG. 13 is an underside perspective view of the embodiment of the compressive force finger guard of FIG. 11.
Figure 14:
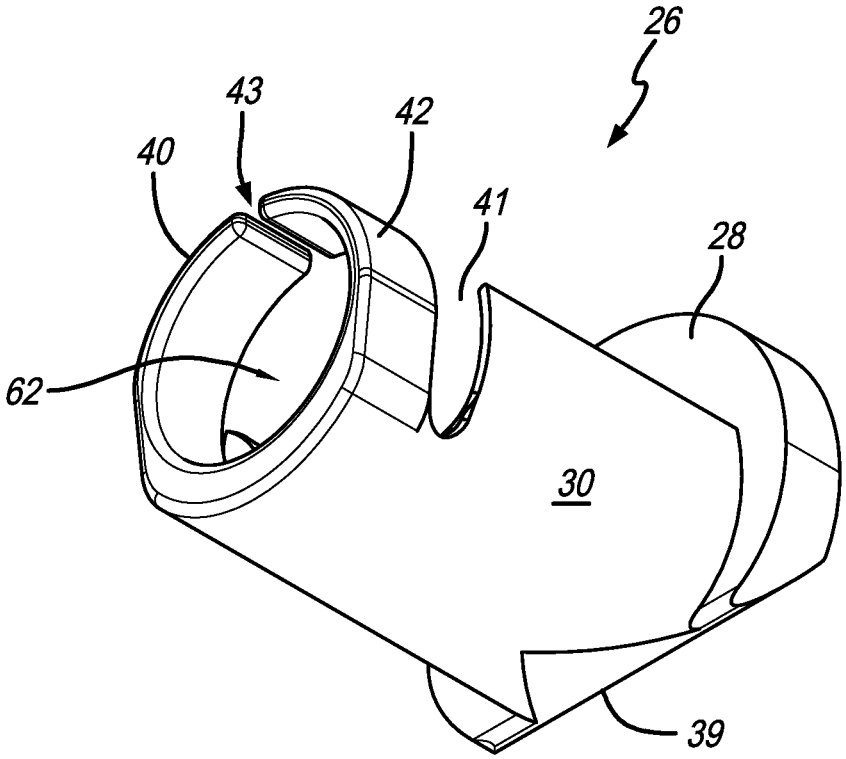
FIG. 14 is a rear underside prospective view of the compressive force finger guard of FIG. 11.
Figure 15:
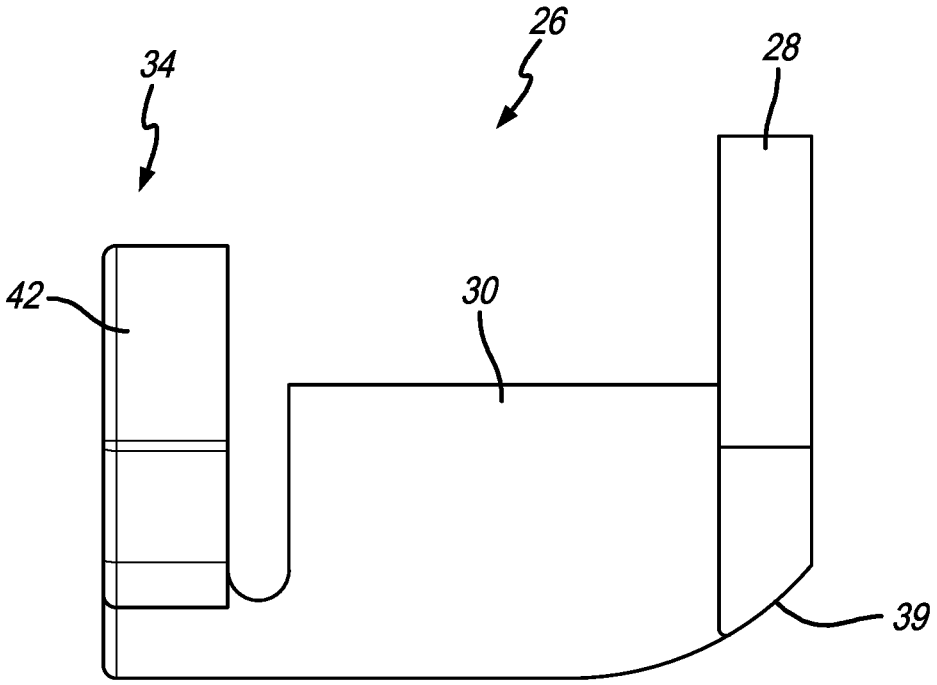
FIG. 15 is a side view of the compressive force finger guard of FIG. 11.

A perspective side view of finger 6, with finger guard 26 secured thereon, is shown in FIG. 12. This view shows body 30 that connects to guard tip 28 and finger strap 34. In this view, it can be appreciated how guard tip 28 extends above the top of fingernail 36 of finger 6, thereby providing a barrier between would-be clamping structures and the finger. If clamping members attempt to clamp down on finger 6, they will be stopped by larger guard tip 28.

Several views of finger guard 26 are shown in FIGS. 13, 14, 15, 16, and 17. The perspective and reverse perspective views of finger guard 26 shown in FIGS. 13 and 14 further depict the relative size of guard tip 28 versus body 30 to create the similar functions as that described with respect to guard tip 22 of finger guard 20. Also shown are strap portions 40 and 42 of finger strap 34. The diameter of the flange of the guard tip 28 is wider than a diameter of the body and the finger strap without the flange, as seen in FIGS. 13-17. In the illustrative embodiment, they operate as that previously described with respect to strap portions 44 and 46 of finger guard 20 previously discussed. Again, gap 43 similar to gap 50 exists between strap portions 40 and 42. A chamfered surface 39 angles upward from body 30 to guard tip 28 as shown to provide a more finger-tip-type surface. Slot 41 (similar to slot 35 of finger guard 20) is located between body 30 and finger strap 34.

The side view of finger guard 26 shown in FIG. 15 again highlights the size of guard tip 28 versus body 30. Similar to the other views, FIG. 15 demonstrates how guard tip 28 may serve the function of providing an obstruction and/or support to keep fingers out of certain areas and/or provide a wedge to protect fingers if they get caught between clamping surfaces.

Figure 16:
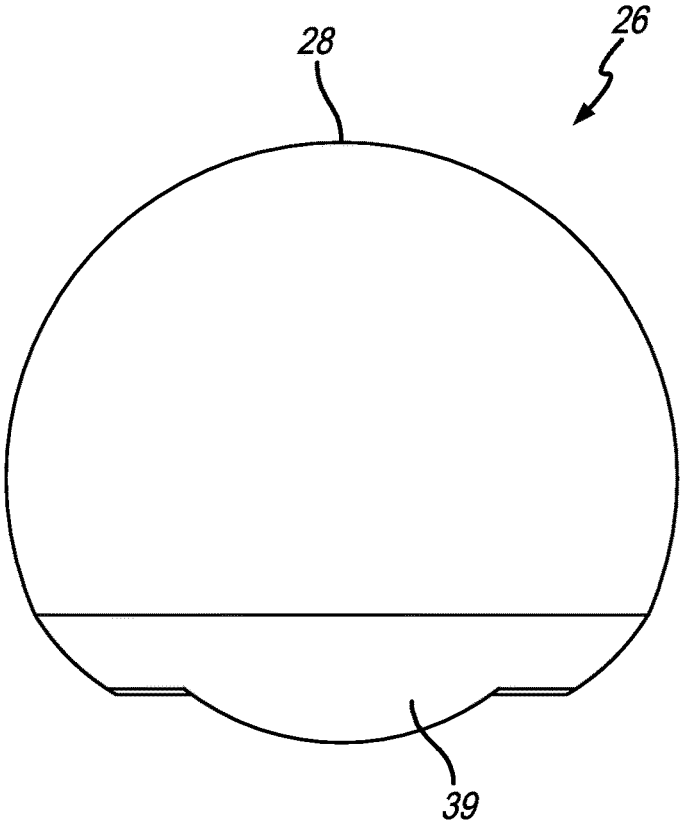
FIG. 16 is a front view of the compressive force finger guard of FIG. 11.
Figure 17:
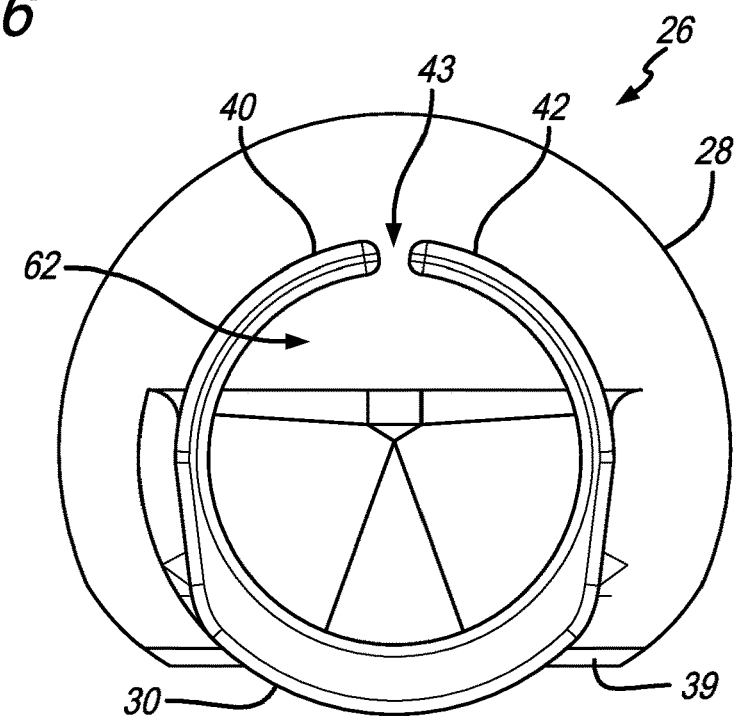
FIG. 17 is a rear elevation view of the compressive force finger guard of FIG. 11.

Front and rear views of finger guard 26 are shown in FIGS. 16 and 17. These views again depict illustrative characteristics of finger guard 26. The relative size of guard tip 28 versus body 30 is highlighted in these views. Also shown in FIG. 17 is opening 62 located between strap portions 40 and 42 configured to receive a finger.

In the illustrative embodiment finger guard 26 (as well as finger guard 20) may be made from a polymer that can have portions become resilient if they are thin enough like that shown. Each thin band is illustratively composed of two separate curved strap portions 40 and 42 that bias toward the direction of the finger so that when it is inserted into opening 62 (see, also FIGS. 11, 12, and 14), the curved portions 40 and 42 separate. But because those curved strap portions are resilient they tend to bias towards their original position which provides a gentle clamping force around the finger, thereby securing finger guard 26 in place on the finger.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should also be appreciated that any subject matter disclosed in this non-provisional patent application that may differ from the priority application, the disclosure from this non-provisional patent application controls.

What is claimed is:

1. A finger guard sized to cover at least a portion of the distal phalanx portion of a finger, comprising:

a longitudinally-extending body portion sized to receive and shroud at least a longitudinal extent of the portion the distal phalanx portion of the finger;

a cap tip located on an end of the longitudinally-extending body portion and sized to engage and cover a fingertip end of the distal phalanx portion of the finger;

wherein the cap tip at the fingertip end of the distal phalanx includes a flange extending generally transverse to the longitudinally-extending body portion and the longitudinal extent of the distal phalanx portion of the finger when received in the longitudinally-extending body portion such that at least a portion of the flange extends above all of the longitudinally-extending body portion;

a finger strap sized to extend around at least a portion of the distal phalanx portion of the finger;

wherein the finger strap forms an opening sized to receive the distal phalanx portion of the finger;

an opening in the longitudinally-extending body portion adjacent the cap tip, opposite the flange, and discrete from the opening formed by the finger strap; and wherein a diameter of the flange is wider than a diameter of the longitudinally-extending body portion and the finger strap without the flange.

2. The finger guard of claim 1, wherein the finger strap is biased toward the finger to secure the finger guard to the finger.

3. The finger guard of claim 1, wherein the finger guard is fitted inside a finger portion of a glove.

4. The finger guard of claim 1, wherein the finger guard is made from a polymer material.

5. The finger guard of claim 2, wherein at least the strap is made from a polymer that creates the bias toward the finger to secure the finger guard to the finger.

6. The force finger guard of claim 1, wherein the flange is radially arcuate.

7. The finger guard of claim 2, wherein the strap is resilient to create the bias toward the finger to secure the finger guard to the finger.

8. The finger guard of claim 1, wherein the cap tip includes a chamfered surface located adjacent the flange and the opening in the longitudinally-extending body portion adjacent the cap tip.

9. A finger guard sized to cover at least a portion of the distal phalanx portion of a finger, comprising:

a longitudinally-extending body portion;

a cap tip located on an end of the longitudinally-extending body portion;

wherein the cap tip includes a flange that extends from the longitudinally-extending body portion generally transverse to the longitudinally-extending body portion; and a finger strap sized to extend around at least a portion of the distal phalanx portion of the finger;

wherein a diameter of the flange is wider than a diameter of the longitudinally-extending body portion and the finger strap without the flange.

10. A finger guard sized to cover at least a portion of the distal phalanx portion of a finger, comprising:

a longitudinally-extending body portion sized to shroud at least the portion of the distal phalanx portion of the finger; and a cap tip located on an end of the longitudinally-extending body portion and sized to cover at least a portion of the distal phalanx portion of the finger;

wherein the cap tip includes a flange extending generally transverse to the longitudinally-extending body portion; and a finger strap sized to extend around at least a portion of the distal phalanx portion of the finger;

wherein a diameter of the flange is wider than a diameter of the longitudinally-extending body portion without the flange.

11. The finger guard of claim 10, wherein the strap is biased toward the finger to secure the finger guard to the finger.

12. The finger guard of claim 10, wherein the longitudinally-extending body portion is sized to shroud at least the portion of a fingertip portion of the distal phalanx portion of the finger opposite a finger nail portion.

13. The finger guard of claim 10, wherein the diameter of the flange is wider than a diameter of the longitudinally-extending body portion and the strap without the flange.

* * * * *